US007170463B1

(12) United States Patent
Seavey

(10) Patent No.: US 7,170,463 B1
(45) **Date of Patent: *Jan. 30, 2007**

(54) BROADBAND OMNIDIRECTIONAL ARRAY ANTENNA SYSTEM

(75) Inventor: John M. Seavey, Cohasset, MA (US)

(73) Assignee: Antenna Research Associates, Inc., Pembroke, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/140,704

(22) Filed: May 31, 2005

Related U.S. Application Data

(63) Continuation-in-part of application No. 11/036,449, filed on Jan. 15, 2005.

(51) Int. Cl.
*H01Q 9/16* (2006.01)

(52) U.S. Cl. ..... 343/793; 343/790; 343/798

(58) Field of Classification Search ..... 343/790, 343/792, 793, 798, 800
See application file for complete search history.

(56) References Cited

U.S. PATENT DOCUMENTS

| | | | | |
|---|---|---|---|---|
| 4,186,403 | A | 1/1980 | Dorne | |
| 4,369,449 | A * | 1/1983 | MacDougall | 343/790 |
| 4,638,813 | A * | 1/1987 | Turner | 607/154 |
| 5,274,391 | A * | 12/1993 | Connolly | 343/820 |
| 6,911,947 | B1 * | 6/2005 | Cranor et al. | 343/741 |

* cited by examiner

*Primary Examiner*—Tho Phan
(74) *Attorney, Agent, or Firm*—Kenneth W. Float

(57) ABSTRACT

Broadband omnidirectional, vertically polarized communications antenna systems are disclosed. The antenna systems comprises a plurality of center-fed stacked dipole radiating elements disposed along a central axis, a coaxial feed line coupled between each of the stacked radiating elements. In certain embodiments, a two-wire balun is coupled to a feed point of each radiating element and a shunt inductor and capacitor are coupled to each radiating element. Other embodiments do not require the use of the balun. Certain embodiments use a printed-circuit dipole having a flat shape. Other embodiments use a metal dipole having a cylindrical shape. The array antenna systems may be stacked vertically in separate bays each with its independent RF port.

20 Claims, 12 Drawing Sheets

BROADBAND OMNIDIRECTIONAL ARRAY ANTENNA SYSTEM

This is a CIP of Ser. No. 11/036,449, filed on Jan. 15, 2005.

BACKGROUND

The present invention relates generally to antennas, and more particularly, to an improved broadband omnidirectional, vertically polarized communications antenna system.

There are applications where it is desired to have a vertically polarized antenna that provides a circular horizontal plane pattern and a highly directional vertical plane pattern having a single principal lobe directed at the horizon. Broadband omnidirectional, vertically polarized communications antennas of the type similar to the present invention are very widely used throughout the world, and many different designs exist. Many antenna designers have worked out ways to feed the radiating elements. U.S. Pat. No. 4,186,403, entitled "Antenna formed of non-uniform series connected sections" issued Jan. 29, 1980 to Arthur Dorne, provides general background relating to omnidirectional, vertically polarized antennas.

This type of antenna is useful to the military, for example, to enhance communication data rates for Armed Forces radios. The present invention provides for a solution to the need for an improved high bandwidth radio antenna that has not heretofore been available.

No conventional antenna provides for a very broadband, slender, omnidirectional, vertically polarized antenna that is capable of handling reasonably large CW RF power, has good omnidirectionality, has its main beam on the horizon at all frequencies, has enhanced coverage in the upper hemisphere, and has low internal losses. The principal problem has been a limited frequency bandwidth. It would therefore be desirable to have a broadband omnidirectional, vertically polarized communications antenna that provides for all of these capabilities, and in particular has improved bandwidth. Conventional broadband, omnidirectional, vertically polarized antennas have not achieved the wide bandwidth provided by the present invention.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
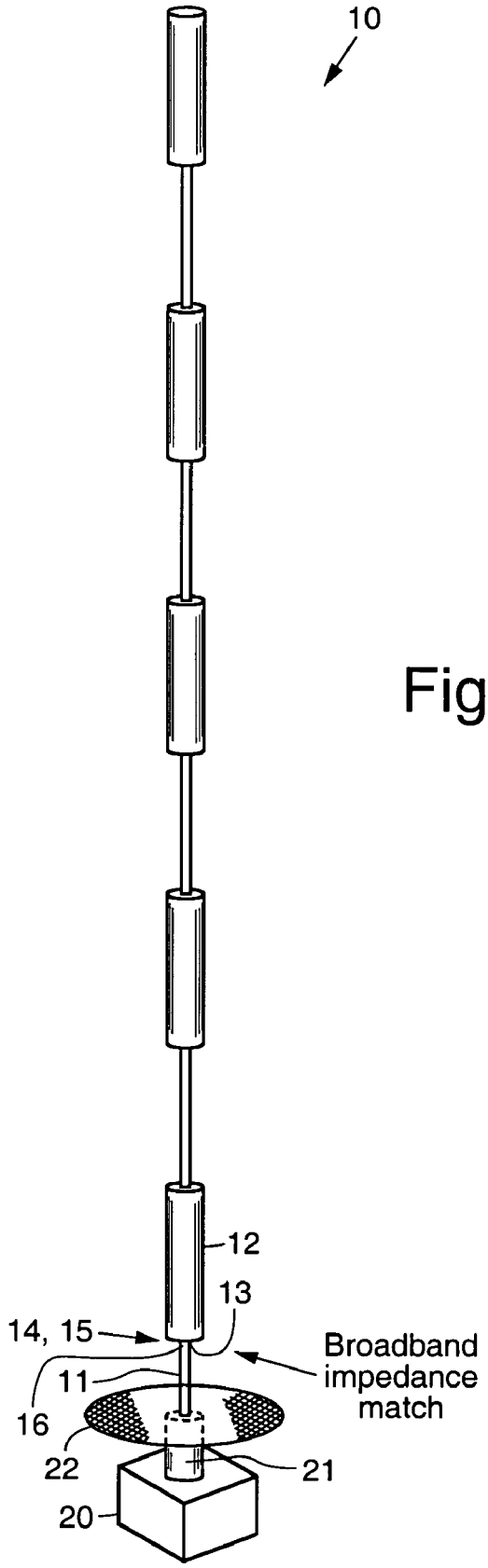
FIG. 1 illustrates an exemplary antenna system in accordance with the principles of the present invention.

Referring to the drawing figures, FIG. 1 illustrates an exemplary array antenna system 10 in accordance with the principles of the present invention. The exemplary antenna system 10 provides for a broadband omnidirectional, vertically polarized communications antenna system 10.

The array antenna system 10 has the following specification and characteristics. Its operating frequency is from 400–970 MHz and from 1,200–2,000 MHz, using one or two RF ports or bays. It is vertically polarized. Its gain ranges from 1.75 to 7.25 dBi, depending on frequency. Its RF power is 200 watts CW minimum. Its VSWR is 3:1 maximum. Its beam pattern has a peak on the horizon, with coverage to at least +30 degrees elevation and omnidirectional in azimuth. Its size has a 3 meter maximum height, and its diameter is 2" tapering to 1". It is designed and constructed to withstand a rugged, sealed, heavy military tactical environment including use on HMMWV army vehicles, for example.

As was mentioned above, the principal problem with conventional broadband omnidirectional, vertically polarized communications antennas is its limited frequency bandwidth. The present omnidirectional, vertically polarized antenna system 10 has a very wide bandwidth, namely between 400–970 MHz and between 1,200–2,000 MHz.

Novel features of the exemplary array antenna system 10 include a broadband impedance match for individual radiating elements 12 in the presence of coaxial feed lines 11. The element VSWR over the 400–1000 MHz band in the present array antenna system 10 is better than 2.5:1.

Referring to FIG. 1, the array antenna system 10 comprises a base 20 from which a optional choke 21 vertically extends. A ground plane 22 abuts the choke 21. A plurality of coaxial feed lines 11 interspaced with radiating elements 12 extend vertically above the ground plane 22.

Radiating elements 12 are stacked, center-fed "modified bow-tie" dipoles 12. Center-feeding improves the elevation pattern shape. Feed lines 11 are coaxial cables 11. A two-wire balun 13 is used at each element's feed point. The dipoles 12 are located on the central axis of the array antenna system 10. The dipoles 12 and balun 13 are preferably a printed-circuit. Each bow-tie dipole 12 includes a shunt printed-circuit inductor 14 and capacitor 15 (generally designated).

Radiating elements 12 of the array antenna system 10 are fed in phase. This eliminates frequency-scanning effects which occur with end-feeding. Radiating elements 12 of the array antenna system 10 are fed with one end element 12 excited with a greater amplitude than the others. This results in upper-hemisphere null-filling. This is required to communicate with aircraft, for example.

The coaxial cables 11 (feed lines 11) are used to feed the stacked radiating elements 12 and are run at a radius of 1" (for the lowest band array) and alternate their angular position by 180 degrees from element to element. Vertical element spacing is about 0.55 wavelengths at the lowest frequency.

Alternating the positions of the coaxial cable feed lines 11 improves the omnidirectionality of the array antenna system 10. In the vicinity of each feed point, ferrite beads 16 are placed over the feed lines 11. These create a high impedance to common-mode currents on the feed cable outer conductors. The ferrite beads 16 improve the VSWR of the radiating element 12.

The good impedance match of the radiating elements 12 is achieved by arrangement of the capacitor, inductor, bead type and location, as well as the dipole length, width and feed point/balun dimensions. The use of NiZn ferrite material work acceptably well in the 1 GHz frequency range when used in this manner. Steward Ferrite type 28 ferrite material or Fair-Rite type 68 ferrite material may also be used. The use of such ferrite material are used to suppress the common-mode current.

Figure 2:
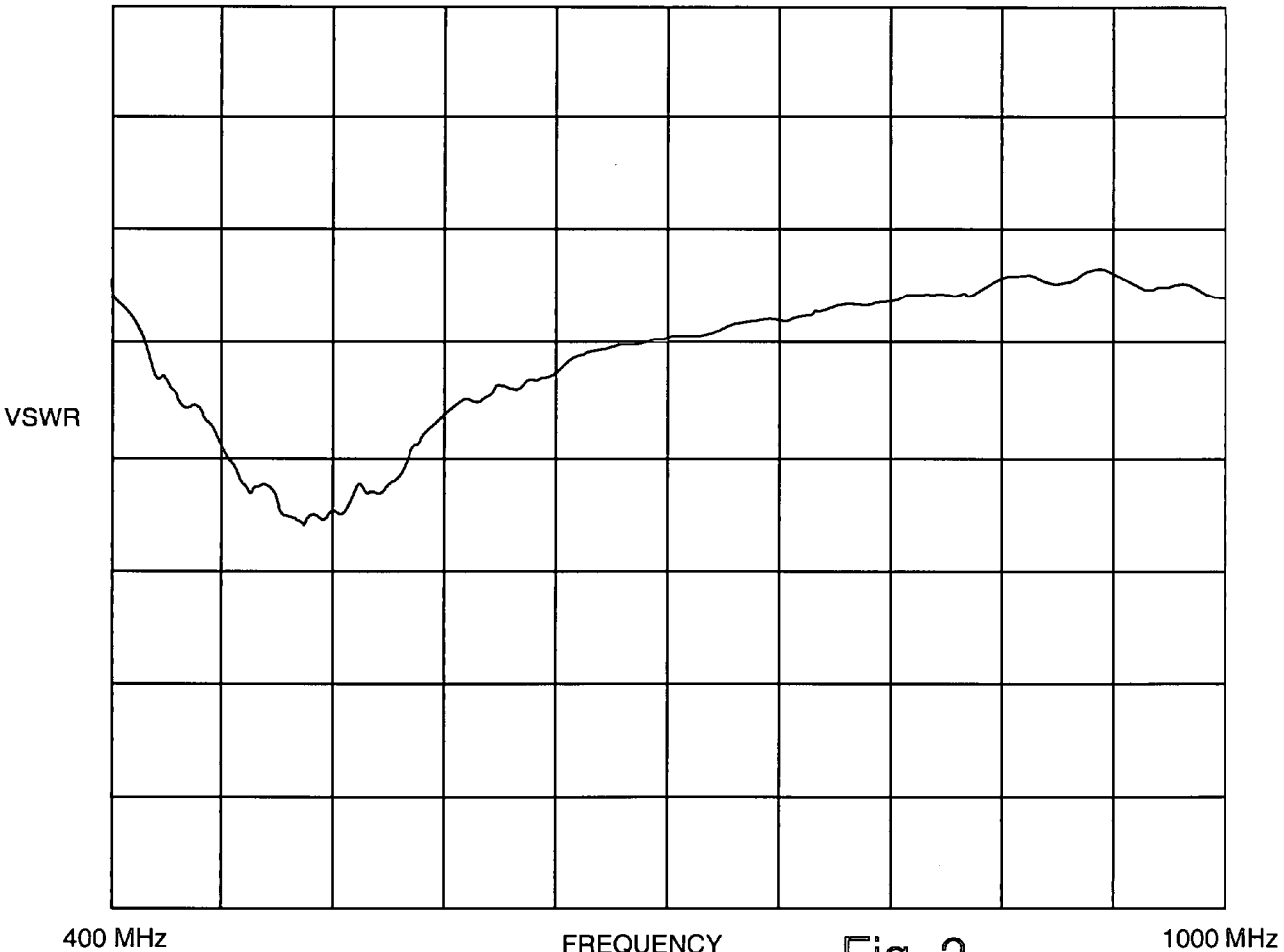
FIG. 2 is a graph that illustrates return loss versus frequency for the exemplary antenna system between 400 MHz and 1000 MHz.
Figure 3:
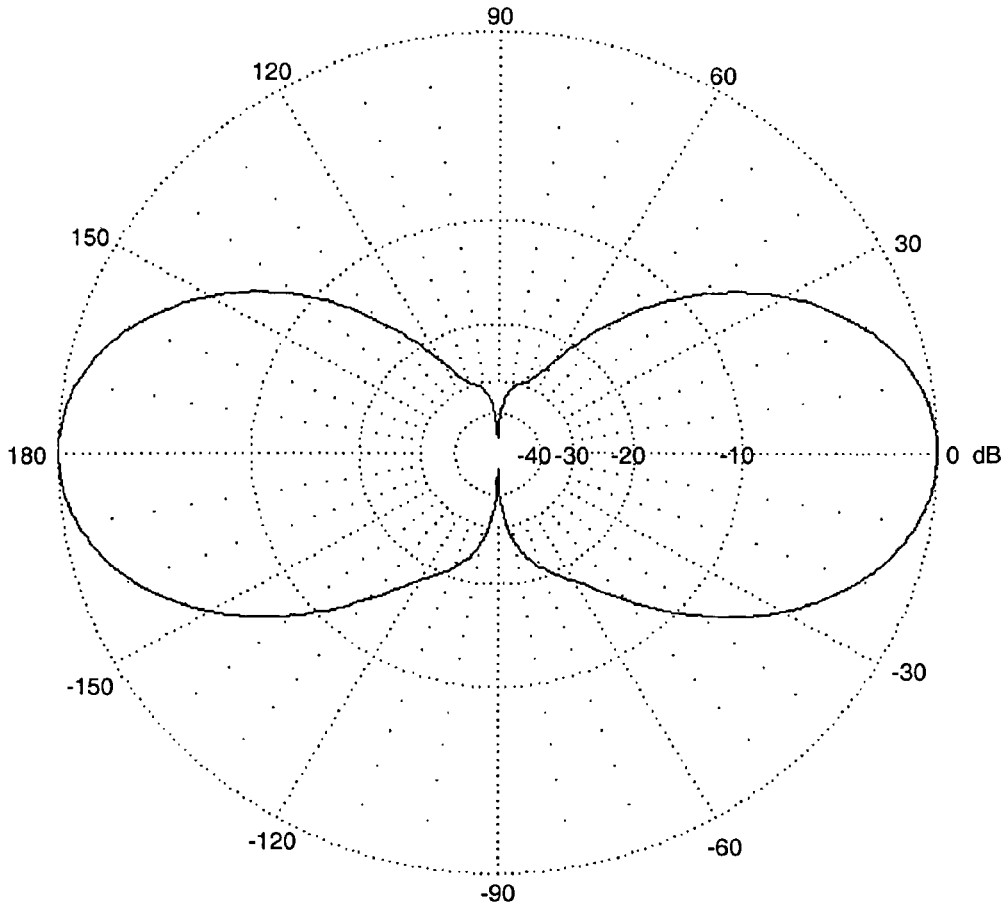
FIG. 3 is a polar graph that illustrates a radiation pattern for the exemplary antenna system at 400 MHz.
Figure 4:
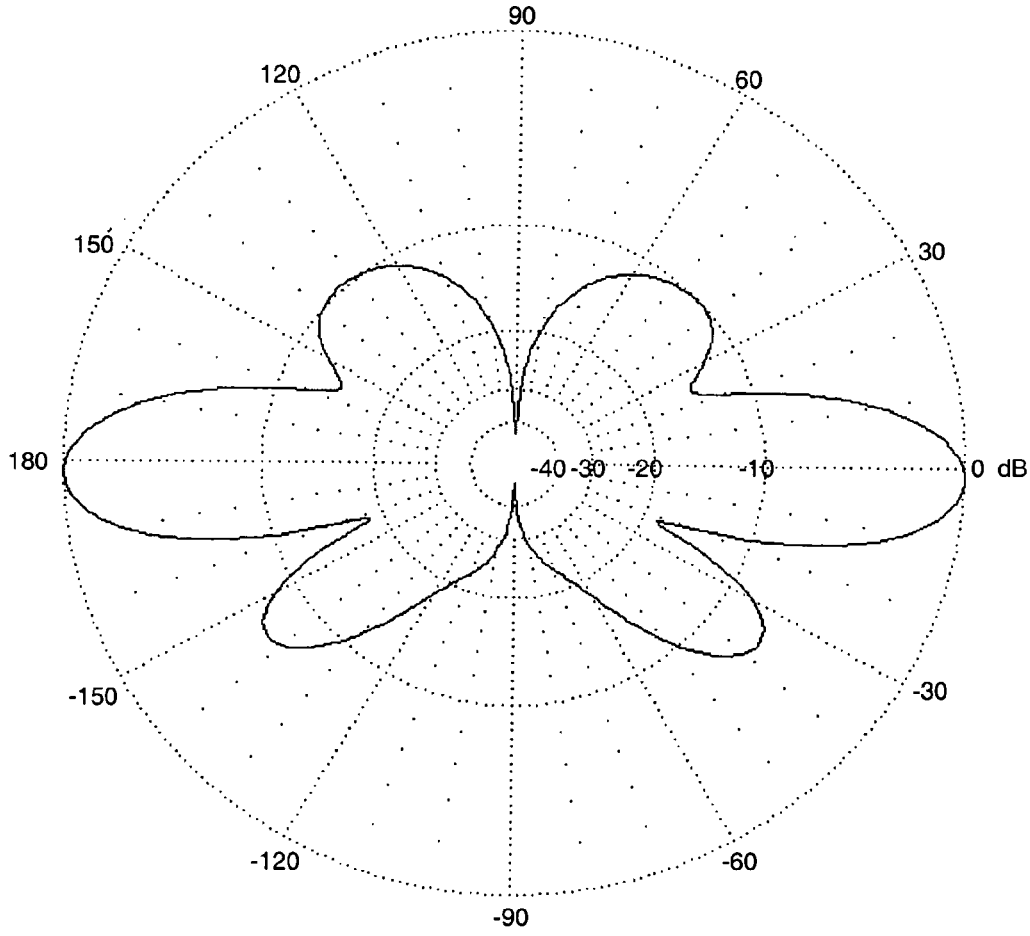
FIG. 4 is a polar graph that illustrates a radiation pattern for the exemplary antenna system at 970 MHz.
Figure 5:
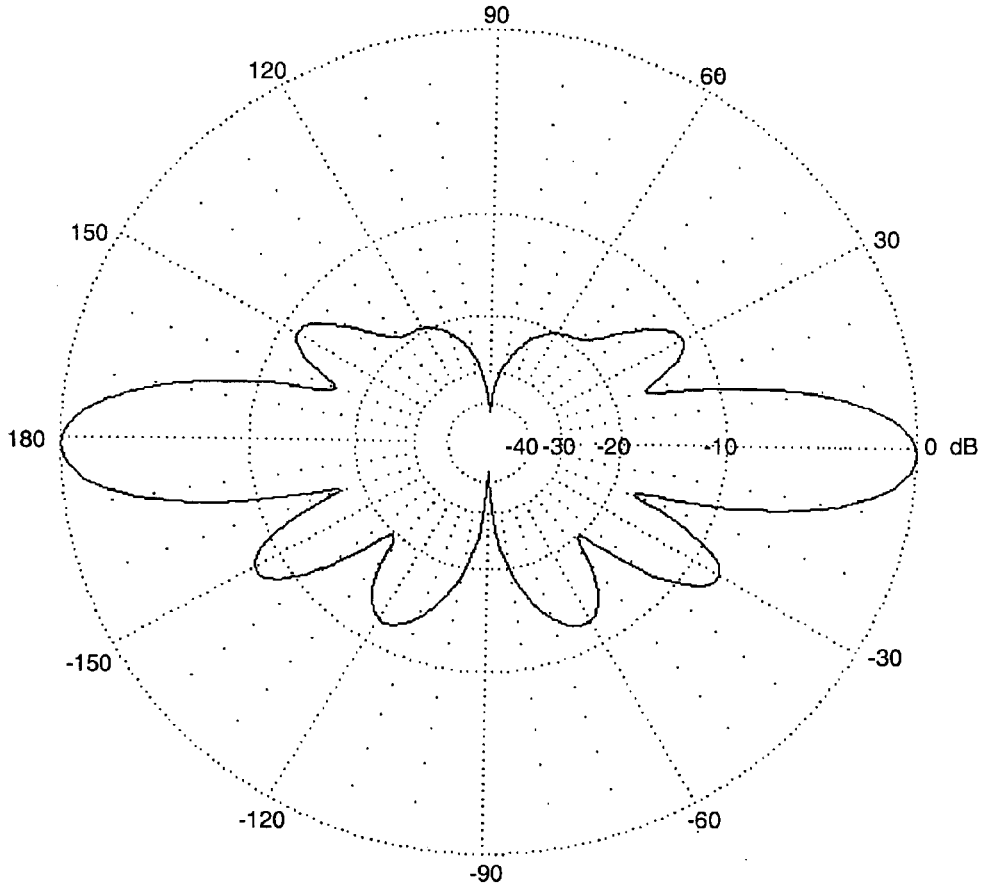
FIG. 5 is a polar graph that illustrates a radiation pattern for the exemplary antenna system at 1200 MHz.
Figure 6:
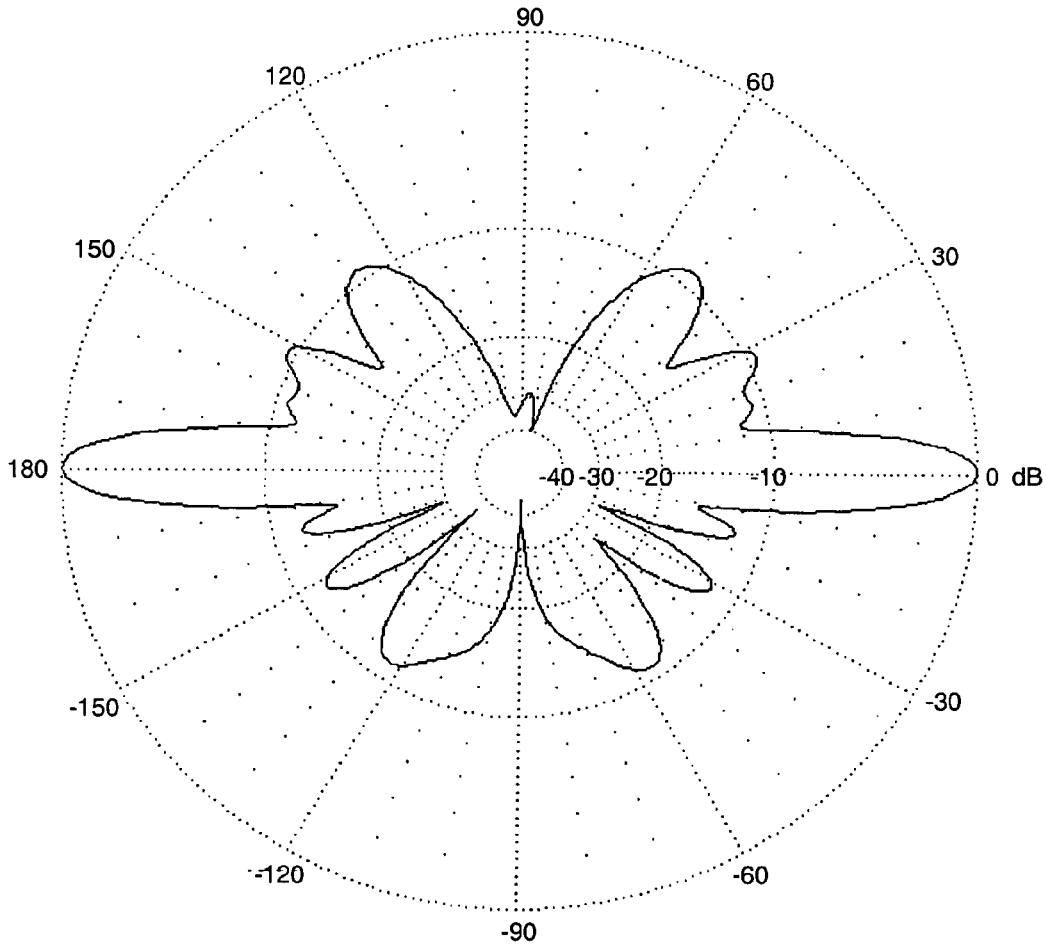
FIG. 6 is a polar graph that illustrates a radiation pattern for the exemplary antenna system at 2000 MHz.

The exemplary array antenna system 10 has been model/tested in order to confirm its operability. FIGS. 2–6 are graphs illustrating the performance of an exemplary array antenna system 10. More particularly, FIG. 2 is a graph showing typical swept VSWR (return loss) versus frequency between 400 MHz and 1000 MHz for an exemplary four-element array antenna system 10. FIG. 3 is a polar graph showing a typical elevation radiation pattern for the antenna system 10 at 400 MHz. FIG. 4 is a polar graph showing a typical elevation radiation pattern for the antenna system 10 at 1000 MHz. FIG. 5 is a polar graph showing a typical elevation pattern for the antenna system 10 at 1200 MHz. FIG. 6 is a polar graph showing a typical elevation radiation pattern for the antenna system 10 at 2000 MHz.

Figure 10A:
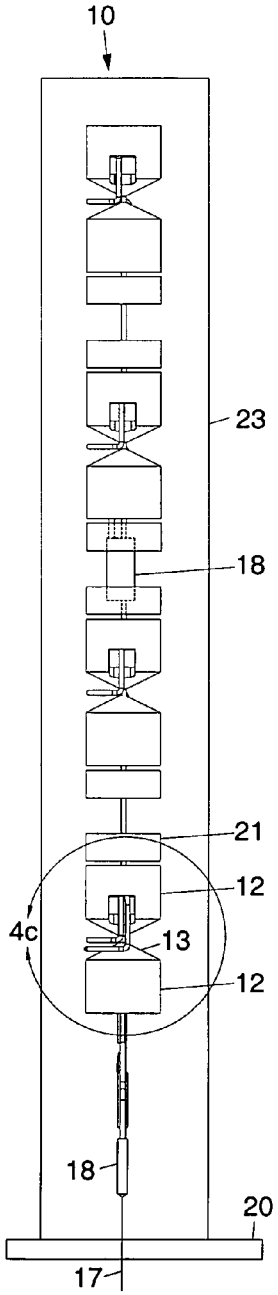
FIGS. 10*a*–10*c* illustrate various views of an exemplary four-element array antenna system employing another embodiment of the antenna element.
Figure 10B:
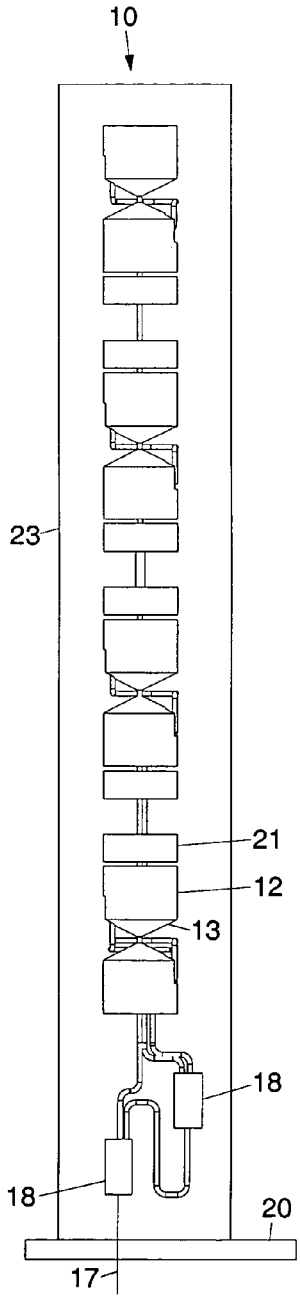

The present invention provides for a very broadband, slender, omnidirectional, vertically polarized communications array antenna system 10. The array antenna system 10 comprises a plurality of radiating elements 12 that are stacked center-fed dipoles 12, such as are shown in FIGS. 10*a* and 10*b*, for example, that provide for improved elevation pattern shape. The dipoles 12 are located along a central axis of the array antenna system 10.

Additional embodiments of the array antenna system 10 are described below. They differ in the construction details of the radiating elements 11. The first embodiment of the array antenna system 10 uses a printed-circuit dipole 12 having a flat shape. The second embodiment of the array antenna system 10 uses a metal dipole 12 having a cylindrical shape.

Reduced to practice embodiments of the array antenna system 10 have the following specification and characteristics. Its operating frequency is from 1,200–2,000 MHz and has one RF port 17. It is vertically polarized. Its gain ranges from 4.5 to 7.5 dBi, depending on frequency. Its RF power capacity is 200 watts CW minimum. Its VSWR is 3:1 maximum. Its beam pattern has a peak on the horizon, with coverage to at least +30 degrees elevation. It is omnidirectional in azimuth. Its height is 33 inches, and its diameter is 2 inches. It is designed and constructed to withstand a rugged, sealed, heavy military tactical environment including use on HMMWV army vehicles, for example.

Radiating Element of the First Embodiment

Figure 7A:
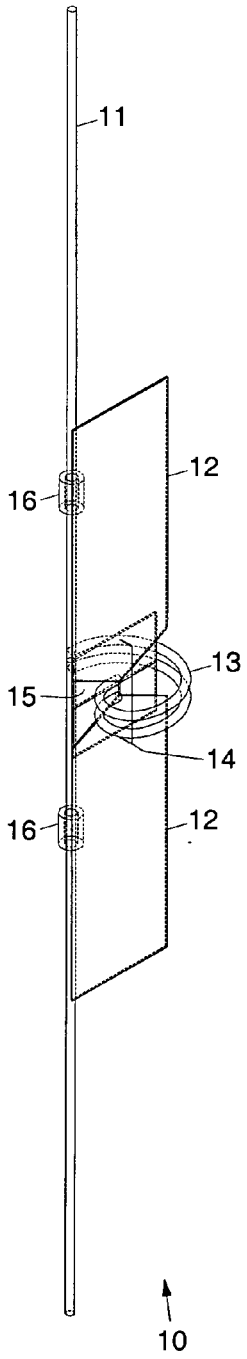
FIGS. 7*a*–7*e* illustrate various views of an embodiment of an antenna element that may be used in antenna systems in accordance with the principles of the present invention.
Figure 7B:
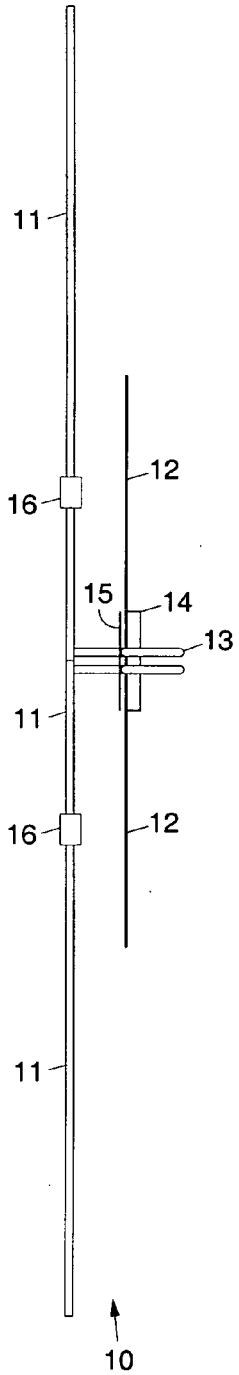
Figure 7C:
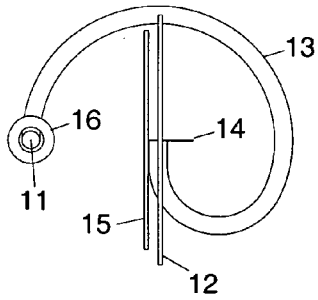
Figure 7D:
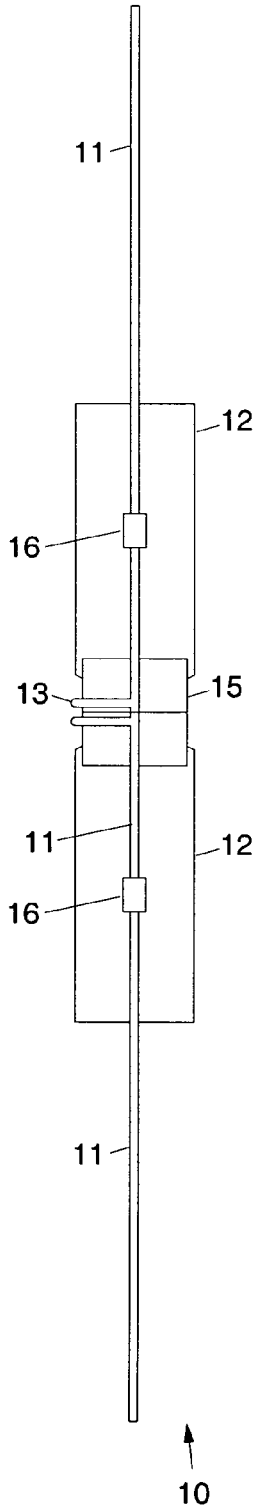
Figure 7E:
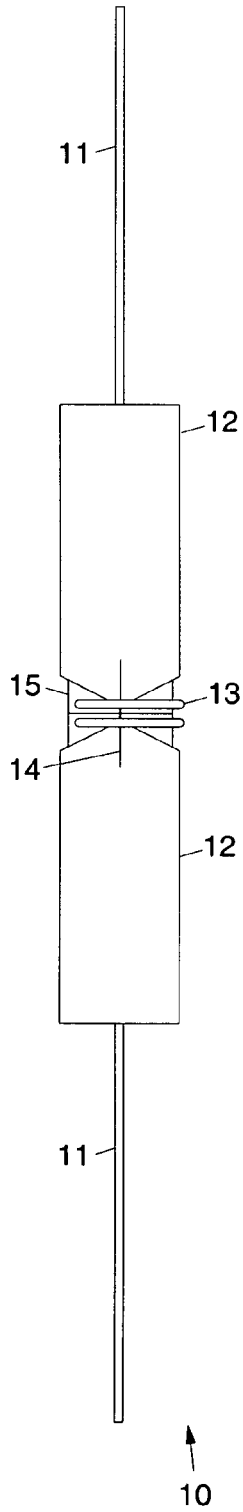

Referring to FIGS. 7*a*–7*e*, they illustrate various views of an exemplary embodiment a radiating element 12 (dipole 12) that may be used in the present array antenna systems 10. FIG. 7*a* is a perspective-like view of the radiating element 12. FIG. 7*b* shows a side view of the radiating element 12. FIG. 7*c* shows a top view of the radiating element 12 shown in FIG. 7*b*. FIG. 7*d* shows a left side view of the radiating element 12 shown in FIG. 7*b*. FIG. 7*e* shows a right side view of the radiating element 12 shown in FIG. 7*b*.

In this embodiment the dipoles 12 and balun 13 are preferably a printed-circuit. Each bow-tie-shaped dipole 12 comprises a shunt printed-circuit inductor 14 and capacitor 15. The inductor 14 comprises a wire 14 that is coupled to the capacitor 15, which comprises a capacitance plate 15.

Feed lines 11 are preferably coaxial cables 11 and a two-wire balun 13 is used at the feed point of each dipole 12. The coaxial cables 11 alternate their angular position by 180 degrees from dipole 12 to dipole 12, which improves the omnidirectionality of the array antenna system 10.

The radiating elements 12 may be fed with one end element 12 excited with a greater amplitude than the others to provide upper-hemisphere null filling. This may be required to communicate with aircraft, for example.

In the vicinity of each feed point, ferrite beads 165 are placed over the feed lines 11. These create a high impedance to common-mode currents on outer conductors of the feed line 11. The ferrite beads 16 also improve the VSWR of the dipole 12. NiZn ferrite material works acceptably well in the 1 GHz frequency range when used in this manner. Steward Ferrite Type 28 ferrite material or Fair-Rite Type 68 ferrite material may also be used This array antenna system has a broadband impedance match for individual radiating elements 12 in the presence of the coaxial feed lines 11. The broadband impedance match of the dipoles 12 is achieved by the arrangement of the capacitor 15, inductor 14, type of bead 16 and location, length and width of the dipoles 12, and feed point/balun dimensions.

This array antenna system 10 is capable of handling reasonably large CW RF power, has good omnidirectionality, has its main beam on the horizon at all frequencies, has enhanced coverage in the upper hemisphere via null-filling, has low internal losses, reasonable VSWR and is ruggedly constructed.

Radiating Element of the Second Embodiment

Figure 10C:
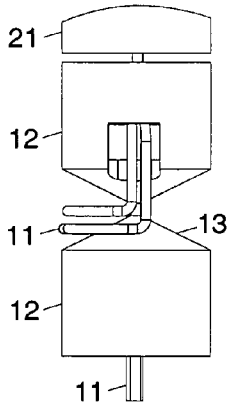

FIGS. 10*a*–10*c* illustrate various views of an exemplary four-element array antenna system employing yet another embodiment of the antenna element 12. In this embodiment, the dipoles 12 are preferably made of conducting metal cylinders and cones, respectively.

Feed lines 11 are preferably coaxial cables 11 with the inner conductor of the coaxial cable 11 connected across gap between both halves of the dipole 12. No balun 13 is required for this design.

The radiating elements 12 may be fed having one end element excited with a greater amplitude than the others to provide upper-hemisphere null-filling if desired.

Common-mode currents are suppressed by means of cylindrical conducting metal chokes 16. No ferrite materials are necessary. The chokes 16 present a high impedance to common-mode currents on the outer conductors of the feed cables 12. The chokes 16 are located at optimum positions along the length of the array antenna system 10. The chokes 16 are preferably located above and below each dipole 12. The chokes 16 are preferably tuned to have a length equal to lambda/4 at mid-band. For a four-element array antenna system 10 having a 1200–2000 MHz bandwidth the chokes 16 are not necessary. For a 400–1000 MHz design using two dipoles 12 the chokes 16 offer improved performance.

In this design the broadband impedance match of the dipole 12 is attained by a conical shaped feed point. This follows standard practice for conical monopole antennas. A constant characteristic impedance can readily be attained. This impedance may be varied by choosing the proportions of the dipole 12 (length/diameter). Characteristic impedance values may be chosen in a range from 40–100 ohms, for example.

All exemplary array antenna systems 10 are capable of handling reasonably large CW RF power, have good omnidirectionality, have their main beam on the horizon at all frequencies, have enhanced coverage in the upper hemisphere via null-filling, have low internal losses, reasonable VSWR, are ruggedly constructed, and are DC grounded.

Array Architectures

These array antenna systems 10 may utilize a plurality of stacked dipoles 12. The number of dipoles 12 is determined by the specifications for gain and elevation beamwidth. The number of dipoles 12 is also limited by the maximum available height of the array antenna systems 10.

Two exemplary array antenna systems 10 comprising two-dipole 12 and four-dipole 12 designs are illustrated in FIGS. 8–10. These are useful for tactical radios operating in the 400–1000 MHz and 1200–2000 MHz frequency bands respectively. They are designated mid-band and high-band in this discussion.

Figure 8A:
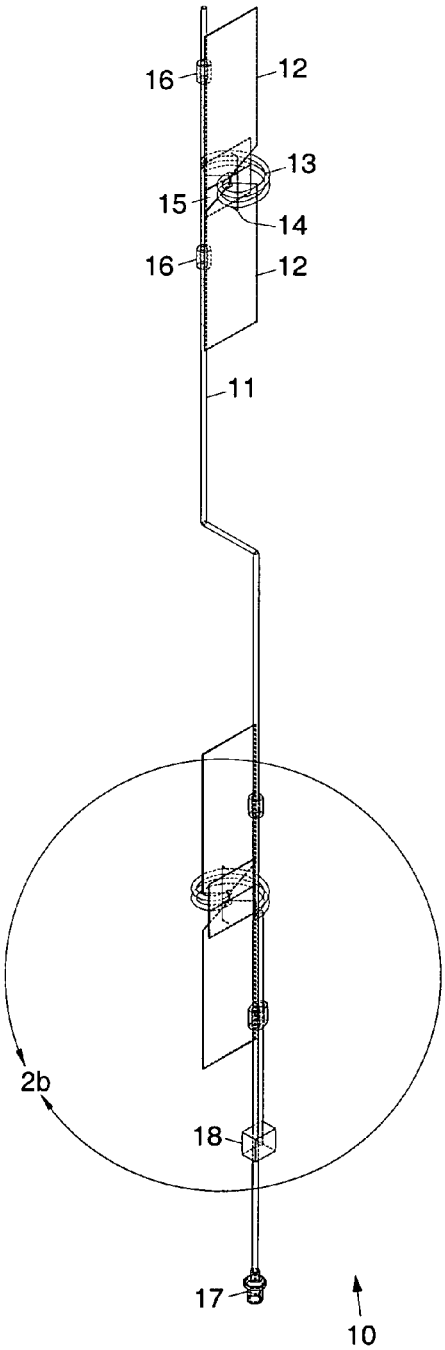
FIGS. 8*a*–8*e* illustrate various views of an exemplary two-element mid-band array antenna system employing the antenna element shown in FIG. 6.
Figure 8B:
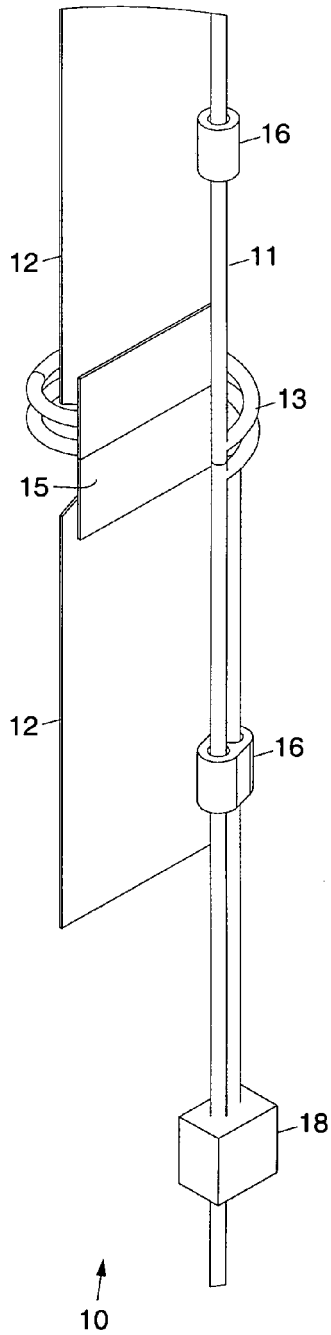
Figure 8C:
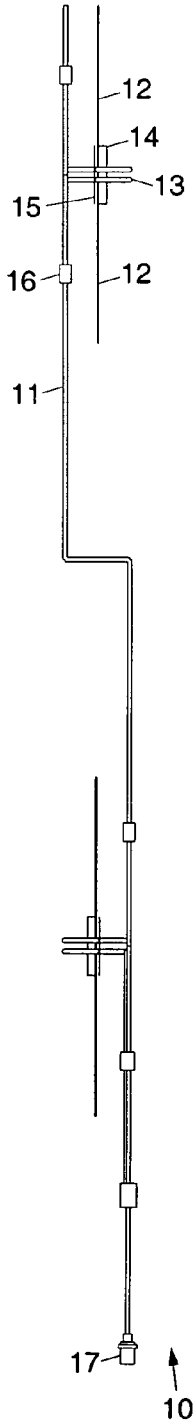
Figure 8D:
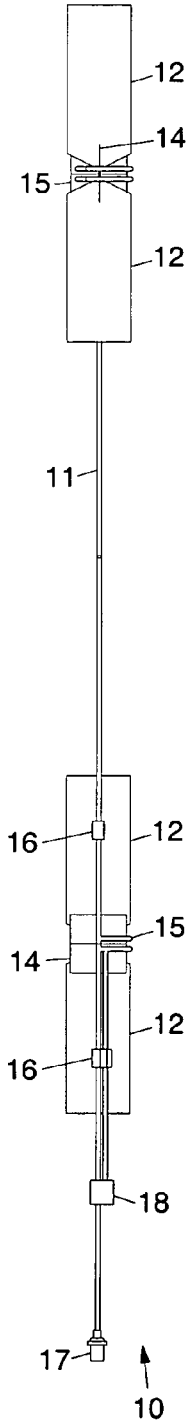
Figure 8E:
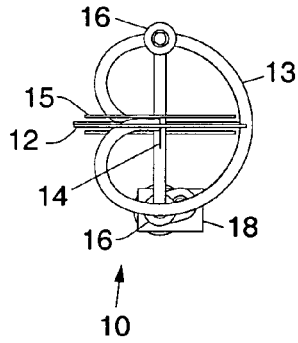

Mid-Band Antenna Array Architecture:

The mid-band array antenna system 10 is illustrated in FIGS. 8*a*–8*e*. FIG. 8*a* is a perspective-like view of the mid-band antenna system 10. FIG. 8*b* shows an enlarged view of the radiating element 12 shown in FIG. 8*a*. FIG. 8*c* shows a top view of the mid-band antenna system 10 shown in FIG. 8*a*. FIG. 8*d* shows a left side view of the mid-band antenna system 10 shown in FIG. 8*a*. FIG. 8*e* shows a top view of the a mid-band antenna system 10 shown in FIG. 8*d*.

This array antenna system 10 comprises two dipoles 12 spaced approximately 0.55 wavelengths apart at the lowest operating frequency.

One coaxial 3-port RF power divider 18 is employed. It is situated preferentially below the bottom dipole 12. If null filling of the elevation pattern is specified, this power divider is asymmetrical with an exemplary power output ratio in the range of 1.1 to 1.2. Practical power dividers of this description can readily be procured with standard Tschebyscheff designs.

The output coaxial lines leading from this power divider are equal in length. This guarantees that the elevation pattern peak will lie on the horizon. If up- or down-tilt of this pattern is specified, the RF cable lengths may be chosen in accordance with standard design principles for arrays.

Figure 9A:
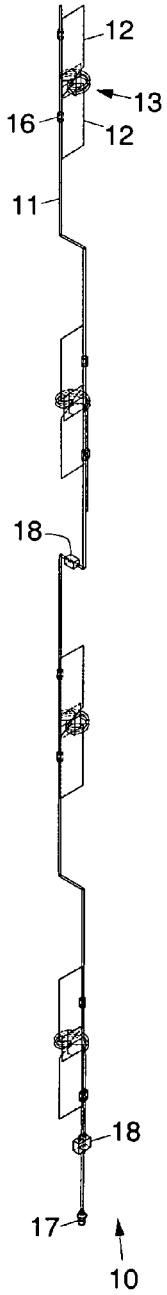
FIGS. 9*a*–9*d* illustrate various views of an exemplary four-element high-band array antenna system employing the antenna element shown in FIG. 6.
Figure 9B:
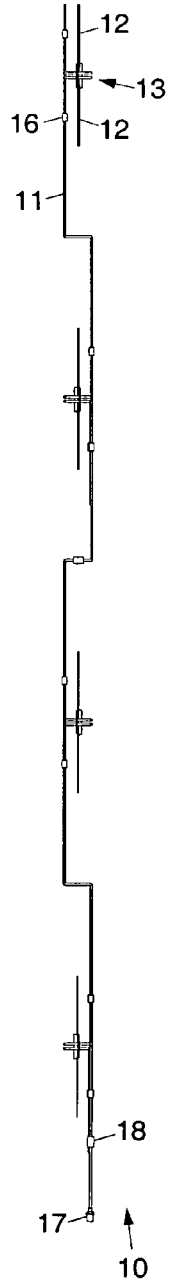
Figure 9C:
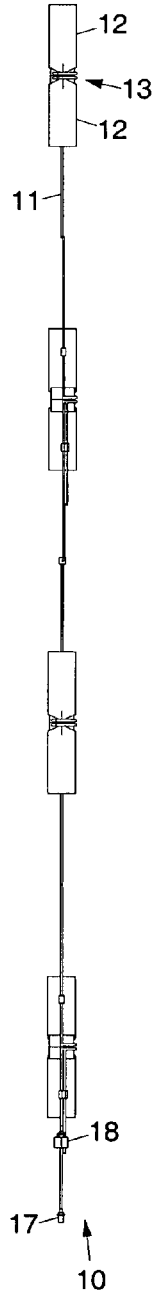
Figure 9D:
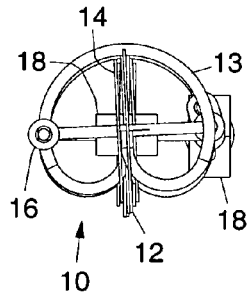

High-Band Antenna Array Architecture:

The high-band array antenna system 10 is illustrated in FIGS. 9*a*–9*d*. FIG. 9*a* is a perspective-like view of the high-band antenna system 10. FIG. 9*b* shows a left side view of the high-band antenna system 10 shown in FIG. 9*a*. FIG. 9*c* shows a top view of the high-band antenna system 10 shown in FIG. 9*a*. FIG. 9*d* shows a top view of the high-band antenna system 10 shown in FIG. 9*a*.

This array antenna system 10 is comprised of four dipoles 12 spaced approximately 0.55 wavelengths apart at the lowest operating frequency. For clarity the dipoles 12 are designated as #1 (top), #2 (below #1), #3 (below #2) and #4 (bottom).

Three 3-port RF power dividers 18 are employed. One is located preferentially between element #2 and element #3 and two are located preferentially below element #4. Lengths of all coaxial cables 11 are chosen so that the driven phase at all dipoles 12 is equal. Again, if up-or down-tilt of the elevation beam is desired, the lengths of the coaxial cable 11 may be changed using standard array design principles.

Arrays Stacked in Bays

These array antenna systems 10 may be stacked vertically in separate bays each with its independent RF port 17. Each bay may be the same as its neighbor for example. Alternatively, each bay may be different. In a practical example, the exemplary two-dipole 12 mid-band array antenna system 10 may be stacked on top of the four-dipole 12 high-band array antenna system 10. This stacked two-bay array antenna system 10 functions over the 400–2000 MHz frequency band with two independent RF ports 17. It is to be understood that other examples are possible.

RF Coaxial Cable Routing

An important feature of these array antenna systems 10 is the means for routing the coaxial cables 11 for the upper dipoles 12 through the lower dipoles 12. With these cable routings, the omnidirectionality and VSWR of the dipoles 12 are optimized.

For the embodiments of the array antenna system 10 shown in FIGS. 8*a*–8*e* and 9*a*–3*d*, for example, the structure of the balun 13 incorporates a route for the feed cables 11. In long, multi-element array antenna systems 10, several feeder cables 11 may be routed in parallel across the balun 13.

For the embodiment of the array antenna system 10 shown in FIGS. 10*a*–10*c*, cable routing is done by looping the cable(s) 11 around the dipole gap by 180 degrees (approximately) and grounding the outer conductor(s) of the cable(s) 11 to the uppermost and lowermost conical portions of the dipole 12.

When array antenna systems 10 are stacked in bays, cable routing for the uppermost bay(s) follows the principles described above. Outer conductors of all upper cables 11 are routed in parallel with those running downwards in their appropriate locations.

In the present antenna systems 10, the radiating elements 12 comprise stacked, cylindrical/conical metal dipoles 12. The dipoles 12 are preferably located on the central axis of the array antenna system 10. The dipoles 12 are center-fed, such as by way of feed lines 11 preferably comprising coaxial cables 11. Cylindrical metal cups 16 form cylindrical chokes 16. The cylindrical chokes 16 are used to suppress common-mode current.

The radiating elements 12 of the array antenna system 10 are fed in phase. This eliminates frequency-scanning effects which occur when end-feeding is used. The radiating elements 12 of the array antenna system 10 are fed with one end element 12 excited with a greater amplitude than the others. This results in upper-hemisphere null-filling. This is generally required to communicate with aircraft, for example.

The coaxial cables 11 (feed lines 11) are used to feed the stacked radiating elements 12 and are run at a radius of about 1 inch and alternate their angular position by 180 degrees from dipole 12 to dipole 12. Vertical spacing of the radiating elements 12 is about 0.55 wavelengths at the lowest frequency. Alternating the positions of the coaxial cable feed lines 11 improves the omnidirectionality of the array antenna system 10 improves the VSWR of the radiating elements 12. Furthermore, as is shown in FIGS. 7*c*, 8*e* and 9*d*, the baluns 13 coupling the coaxial feed lines 11 comprise a 180-degree cable loop with respect to an associated dipole 12.

A reduced to practice embodiment of the array antenna system 10, such as is shown in FIGS. 10*a*–10*c*, for example, includes three power dividers 18, a common RF feed port 17 located adjacent to a support base 20 and a radome cover 23 FIGS. 10*a* and 10*b*), which protects the array antenna system 10 from the environment and mechanically aligns components of array antenna system 10. The radome cover 23 typically comprises a thin-wall laminated dielectric or high-impact plastic material such as polycarbonate. The support base 20 may be a metal mounting plate 20 comprising a ground plane 20. FIGS. 2–6 also illustrate the performance of an exemplary array antenna systems 10 described with reference to FIGS. 7–10.

As was mentioned above, the principal problem with conventional broadband omnidirectional, vertically polarized communications antennas is its limited frequency bandwidth. The present omnidirectional, vertically polarized antenna system 10 has a very wide bandwidth, namely between 1,200 and 2,000 MHz. Another embodiment works over a 400–1000 MHz band using two elements. As noted, both mid-band and high-band array antenna systems 10 may be stacked in bays if desired.

Novel features of the exemplary array antenna system 10 include a broadband impedance match for individual radiating elements 12 in the presence of coaxial feed lines 11. The element VSWR over the 1200–2000 MHz band in the array antenna system 10 is better than 2.5:1.

Other exemplary features of the architecture of the antenna system 10 are mentioned below.

The antenna system 10 is corporate-fed with identical time delay and equal amplitude to all radiating elements 12. This yields maximum horizon gain. All dipoles 12 fed with same time delay to provide for an elevation pattern peak on the horizon to realize maximum horizon gain.

The design of the present antenna system 10 allows for different time delays for specified up or down beam tilt. Since the present invention provides for a corporate array antenna system 10, the beam peak will not change angle with frequency under these conditions.

A design option allows for shortening of selected coaxial cables 11 in one-lambda increments at a selected design frequency to save weight and cost, for example. This results in a frequency-varying beam tilt. This may be employed in certain applications.

Upper or lower elevation null-filling is possible using asymmetrical power dividers 18, if desired. The power dividers 18 comprise coaxial shunt junctions. Alternatively, the power dividers 18 may have microstrip or stripline construction. Many different types of power dividers 18 may be used, but the present invention is not dependent on the use of any particular type of power divider.

The design of the antenna system 10 allows for the possibility of stacked bays. Bays can have the same or different function or frequency band as desired. In this design, coaxial cables 11 that feed the upper dipoles 12 are routed through or around the lower dipoles 12 without shorting them out.

Thus, broadband omnidirectional, vertically polarized communications antenna systems have been disclosed. It is to be understood that the above-described embodiments are merely illustrative of some of the many specific embodiments that represent applications of the principles of the present invention. Clearly, numerous and other arrangements can be readily devised by those skilled in the art without departing from the scope of the invention.

What is claimed is:

1. An antenna system comprising:

a plurality of center-fed stacked dipole radiating elements disposed along a central axis of the antenna system;

a coaxial feed line coupled between each of the stacked dipole radiating elements;

an impedance matching device disposed between each of the stacked dipole radiating elements; and a balun coupled to a feed point of each radiating element.

2. The antenna system recited in claim 1 further comprising a shunt inductor and capacitor coupled to each radiating element.

3. The antenna system recited in claim 2 wherein the balun comprises a two-wire balun.

4. The antenna system recited in claim 1 wherein each dipole comprises a printed-circuit.

5. The antenna system recited in claim 1 further comprising a ferrite bead disposed over each coaxial feed line adjacent each feed point.

6. The antenna system recited in claim 1 wherein the plurality of center-fed stacked dipole radiating elements are center-fed from the coaxial feed lines.

7. The antenna system recited in claim 1 wherein further comprising a cylindrical radome cover.

8. The antenna system recited in claim 7 wherein the baluns provide a route for the coaxial feed lines.

9. The antenna system recited in claim 1 wherein an inner conductor of the coaxial feed lines are routed across gaps between respective halves of the dipole.

10. The antenna system recited in claim 1 wherein an upper coaxial feed line is routed to connect to coaxial feed lines of an upper plurality of center-fed stacked dipole radiating elements disposed above the plurality of center-fed stacked dipole radiating elements.

11. The antenna system recited in claim 10 wherein outer conductors of the upper coaxial feed lines are wired in parallel.

12. The antenna system recited in claim 1 wherein the dipoles comprise conical cylindrical dipoles having a conical gap geometry.

13. The antenna system recited in claim 1 wherein the dipoles comprise metal cylindrical dipoles having a conical gap between dipoles.

14. The antenna system recited in claim 1 wherein a broadband impedance match between dipoles is achieved by arrangement of the shunt inductor and capacitor and inductor, type of bead and location, length and width of the dipoles, and feed point/balun dimensions.

15. The antenna system recited in claim 1 wherein the impedance of the dipoles is varied by appropriate selection of the length and width of the dipoles.

16. The antenna system recited in claim 1 wherein the coaxial feed lines comprise a 180-degree cable loop with respect to an associated dipole.

17. The antenna system recited in claim 1 wherein tops and bottoms of cable loops are grounded to conical cylindrical dipoles.

18. The antenna system recited in claim 1 further comprising cylindrical chokes disposed above and below each dipole.

19. An antenna system comprising:

a plurality of center-fed stacked dipole radiating elements disposed along a central axis of the antenna system;

a coaxial feed line coupled between each of the stacked dipole radiating elements, and wherein the plurality of center-fed stacked dipole radiating elements are center-fed from the coaxial feed lines;

an impedance matching device disposed between each of the stacked dipole radiating elements; and a balun coupled to a feed point of each radiating element.

20. The antenna system recited in claim 19 wherein a broadband impedance match between dipoles is achieved by arrangement of the shunt inductor and capacitor and inductor, type of bead and location, length and width of the dipoles, and feed point/balun dimensions.

* * * * *